US007238244B2

(12) United States Patent
Sato et al.

(10) Patent No.: US 7,238,244 B2
(45) **Date of Patent: *Jul. 3, 2007**

(54) NITRIDING OF IRON AND STEEL PARTS IN SALT BATH HAVING IMPROVED CORROSION RESISTANCE

(75) Inventors: Tokuo Sato, Kanagawa (JP); Yutaka Sawano, Yamanashi (JP); Tetsuya Yamamura, Kanagawa (JP); Kazuyoshi Kurosawa, Tokyo (JP); Humihide Nakamura, Tokyo (JP); Motohiro Tenmaya, Tokyo (JP)

(73) Assignees: Parker Netsushori Kogyo K.K., Tokyo (JP); Nihon Parkerizing Co., Ltd., Tokyo (JP)

( * ) Notice: Subject to any disclaimer, the term of this patent is extended or adjusted under 35 U.S.C. 154(b) by 555 days.

This patent is subject to a terminal disclaimer.

(21) Appl. No.: 10/416,710

(22) PCT Filed: Nov. 28, 2001

(86) PCT No.: PCT/JP01/10369

§ 371 (c)(1),
(2), (4) Date: Aug. 29, 2003

(87) PCT Pub. No.: WO02/44438

PCT Pub. Date: Jun. 6, 2002

(65) Prior Publication Data

US 2004/0025971 A1 Feb. 12, 2004

(30) Foreign Application Priority Data

Nov. 29, 2000 (JP) ..... 2000-363742

(51) Int. Cl.
*C23C 8/50* (2006.01)

(52) U.S. Cl. ..... 148/228

(58) Field of Classification Search ..... 148/228
See application file for complete search history.

(56) References Cited

U.S. PATENT DOCUMENTS 3,645,802 A * 2/1972 Keough ..... 148/509

(Continued)

FOREIGN PATENT DOCUMENTS

EP 0497663 8/1992

(Continued)

OTHER PUBLICATIONS

Office Action in co-pending application No. 10/651,978 dated Aug. 22, 2005.

*Primary Examiner*—Roy King
*Assistant Examiner*—Michael P. Alexander
(74) *Attorney, Agent, or Firm*—Stevens, Davis, Miller & Mosher, LLP

(57) ABSTRACT

A new nitriding process by using a salt bath to produce iron and steel parts having excellent abrasion resistance and corrosion resistance includes forming an iron lithium complex oxide layer at the outermost surface of the iron part by immersing the iron and steel parts in a salt bath containing cationic component of Li, Na and K and anionic components of $CNO^-$and $CO_3^{2-}$, where hydroxide compound selected from lithium hydroxide, sodium hydroxide and potassium hydroxide are added to the salt bath. Materials being in a hydrated state or in a free water containing state can be used for preparation or replenishing of the salt bath. Moistened air of ($1\times10^{-2}$ kg·$H_2O$)/(1 kg dry air) can be used for mixing the salt bath. Containing ratio of Li, Na, K is preferable where a solidifying temperature of the mixture of carbonates of Li, Na, K in that ratio is lower than 500° C. It is preferable that the mol ratio of Na and K is to be 2:8~8:2, the content of $CNO^-$ is to be 5~35 wt %, the content of $CN^-$ in the salt bath is less than 2 wt % and the temperature of the salt bath is to be 450~650° C.

4 Claims, 3 Drawing Sheets

U.S. PATENT DOCUMENTS

| | | | | | |
|---|---|---|---|---|---|
| 3,912,547 | A | * | 10/1975 | Gaucher et al. | 148/218 |
| 3,915,759 | A | * | 10/1975 | Smollett et al. | 148/242 |
| 4,268,323 | A | * | 5/1981 | Jakubowski et al. | 148/218 |
| 4,292,094 | A | | 9/1981 | Kunst et al. | |
| 4,608,092 | A | | 8/1986 | Tremoureux et al. | |
| 5,346,560 | A | | 9/1994 | Mournet et al. | |
| 5,514,226 | A | | 5/1996 | Terrat et al. | |
| 5,518,605 | A | * | 5/1996 | Hadj-Rabah et al. | 205/148 |
| 5,576,066 | A | | 11/1996 | Polti | |

FOREIGN PATENT DOCUMENTS

| | | | |
|---|---|---|---|
| JP | 45-8771 B1 | * | 3/1970 |
| JP | 458771 | | 3/1970 |
| JP | 5633473 | | 4/1981 |
| JP | 60211062 | | 10/1985 |
| JP | 05195194 | | 8/1993 |
| JP | 05263214 | | 10/1993 |
| JP | 07062522 | | 3/1995 |
| JP | 07076766 | | 3/1995 |
| JP | 07224388 | | 8/1995 |
| WO | 0244438 | | 6/2002 |

* cited by examiner

Relation between Temperature, Concentration of Cyanate and Concentration of Cyanide in Salt Bath

| Day | 1st | 2nd | 3rd | 4th | 5th | 6th | 7th | 8th |
|---|---|---|---|---|---|---|---|---|
| $CNO^-$ : 15wt%, 580℃ | 0. 095 | 0. 169 | 0. 26 | 0. 34 | 0. 409 | 0. 457 | 0. 542 | 0. 495 |
| $CNO^-$ : 35wt%, 580℃ | 0. 105 | 0. 248 | 0. 402 | 0. 745 | 0. 708 | 0. 954 | 1. 35 | 1. 69 |

(Mol ratio)

| | $Na_2CO_3$ | $K_2CO_3$ | $Li_2CO_3$ |
|---|---|---|---|
| S1 | 45 | 30 | 25 |
| S2 | 26.5 | 42.5 | 31 |
| S3 | 20 | 60 | 20 |
| S4 | 25 | 30 | 45 |
| S5 | 45 | 15 | 40 |
| C1 | 10 | 60 | 30 |
| C2 | 55 | 5 | 40 |

NITRIDING OF IRON AND STEEL PARTS IN SALT BATH HAVING IMPROVED CORROSION RESISTANCE

FIELD OF THE INVENTION

This invention relates to an improvement of corrosion resistance of iron and steel parts obtained by nitriding in a salt bath, which also provides high abrasion resistance and high strength against fatigue.

PRIOR ART

Nitriding process in salt bath, which forms a nitrided layer on a surface of iron and steel materials, has been utilized to improve strength of the surface of those iron and steel materials,thereby to enhance abrasion resistance and strength against fatigue of those materials. The nitrided layer formed by the above-described processing has also a function to prevent a corrosion loss of the materials. Therefore, if it is the case that corrosion resistance of usual improved level is required, this process may be completed by employing a conventional nitriding process in salt bath.

However, for a use where corrosion resistance at a high level as in hard chromium plating is required, which is a competitive surface hardening process, further processing must be made in addition to the nitriding process in salt bath.

Improvement of corrosion resistance of iron and steel parts by nitriding process has been reported in JP56-33473A, JP60-211062A, JP5-263214A, JP05-195194A, JP7-62522A, JP-7-224388A, etc.

In JP56-33473A and JP07-22438A, a combined processing of nitriding process and oxidation bath process is proposed as a method to improve corrosion resistance. The corrosion resistance obtained by this combined processing was found to be as equivalent or superior than that obtained by hard chromium plating process in salt water spray test.

However, since the corrosion resistance level obtained by said combined processing with oxidation bath widely varies, this method was usually not applied in view of a quality control (lower limit value control of products).

Further, a method of using a wax following a nitriding process and oxidation bath process, and a method to apply a polymer coating, have been proposed in, for example, JP05-195194A and JP05-263214A.

The two methods mentioned above are aiming at, as one aspect, lowering an abrasion coefficient of the material and then enhancing abrasion resistance of the material by way of applying either wax or a polymer coating to the material, and, as another aspect, sealing or covering an oxide layer of the material by coating with wax or polymer thereby to enhance corrosion resistance and stability of the material. These two methods improve and stabilize the material properties, such as abrasion resistance, strength against fatigue and corrosion resistance.

However, it is not an easy way to accept in views of investment, production efficiency and cost to incorporate a process of coating of wax or polymer in addition to said oxidation bath process following the nitriding. Based on such a background, the following was proposed.

In JP07-62522A, another nitriding method for providing corrosion resistance to iron and steel parts has been proposed. This method forms an oxide layer on the nitrided layer by performing anodic electrolysis during nitriding process. Since this method requires a single salt bath, it is expected that great advantages in the productivity and production cost can be attained by replacing of conventional two-step process of nitriding process and oxidation bath.

However, the process of anodic electrolysis is executed by using the opposite electrode as a cathode. And, due to a cathodic reaction at the opposite electrode, cyanate compound in the salt bath is reduced to produce cyanide compounds, and accordingly, concentration of the poisonous cyanide compound in the salt bath tends to be increased than in the salt bath where no electrolysis is executed.

In addition, for carrying out an appropriate operation, current density at each site of the iron and steel parts must be controlled in a predetermined range. For this purpose, close attentions are necessary to an arrangement of the electrode and the iron and steel parts to be processed. Furthermore, if the iron and steel parts to be processed has an unsuitable configuration for electrolysis such as having deep holes or bag-shaped holes, employment of this method would be difficult. Therefore, iron and steel parts to be processed by this method must be limited.

Based on the background as described above, there has been a requirement to establish a new method of nitriding process, which comprises single step, does not require an electrolysis, and can provide iron and steel parts having satisfactory abrasion resistance and corrosion resistance.

DISCLOSURE OF THE INVENTION

It is disclosed in JP58-77567A that in a nitriding process using a salt bath comprising anionic components of $CNO^-$ and $CO_3^{2-}$, and two cationic components of $Na^+$ and $K^+$, an unexpected black-colored film in smut form having poor adhesiveness is produced on a surface of the nitrided layer when a content of a by-produced cyanide in the salt bath is low. And, it is known that this film in smut form is a magnetite ($Fe_3O_4$).

The inventors of the present invention carried out more different nitriding of a steel plate using a salt bath comprising anionic components of $CNO^-$ and $CO_3^{2-}$ and three cationic components of $Li^+$, $Na^+$ and $K^+$, where the content of the by-produced cyanide in the salt bath is kept low. In contrast to the result in JP58-77567A using a salt bath containing $Na^+$ and $K^+$ as the cationic component, inventors have obtained a black-colored film with satisfactory adhesion to the material.

Then, the processed steel plate by the inventors was subjected to a salt water spray test to check the corrosion resistance. As a result, the steel plate by the inventors showed to have high corrosion resistance, namely more than 200 hours are required to cause the rust on the surface of the steel plate. With this result, it is judged that the black-colored film with satisfactory adhesion has a function to protect iron and steel parts.

With regard to the reason why this protective film is formed on the surface of material in the salt bath containing a low concentration of a cyanide product, the inventors are supposing as follows.

1. Since the content of the by-producted cyanide having a reducing property is low, oxidizing property of the salt bath is enhanced, thereby causing oxidation of a surface of iron to produce its oxides in parallel to nitriding reaction by a cyanate.

2. Since the concentration of $CN^-$ having a strong power to dissolve the iron is low, and since a capability of the salt bath to dissolve iron oxides produced on a surface of iron is lowered, the oxides can be produced as in 1. above and an oxide film can be formed on the outermost surface.

The inventors of this invention analyzed the film on the steel plate produced by the salt bath of three-component of $Li^+$, $Na^+$ and $K^+$ as described above by means of X-ray diffraction.

As a result, it was found that the film produced by the salt bath of three alkali metal component including lithium is an iron-lithium complex oxide.

Iron-lithium complex oxides, $Li_2Fe_{33}O_4$, $Li_2Fe_3O_5$, $Li_5Fe_5O_8$, LiFe$_5$O.sub.8, $LiFeO_2$, $Li_5FeO_4$, $Li_2Fe_2.4O_{4.6}$ and the like have been known. From the analytical result by X-ray diffraction of the film, $Li_2Fe_3O_4$, $Li_2Fe_3O_5$, $Li_5Fe_5$O.sub.8 and LiFe$_5$O.sub.8 have been observed so far.

Reasons why the film of this iron-lithium complex oxide is adhesive and good in corrosion resistance.

In case of the salt bath of two cationic component of $Na^+$ and $K^+$, a film of (magnetite $Fe_3O_4$) in smut form with poor adhesion is produced on the steel plate. On the other hand, when the salt bath of three cationic component of $Li^+$, $Na^+$ and $K^+$ is used, a film of iron-lithium complex oxide having satisfactory adhesion property and good in corrosion resistance is formed. The inventors of the present invention have supposed the reason as follows.

In case of the salt bath of two component of $Na^+$ and $K^+$, the film produced onto the surface of the steel plate is magnetite($Fe_3O_4$). The both cationic ions of $Na^+$and $K^+$ have a large ionic diameter. Therefore, they cannot be a constituent component of the oxide layer. The constituents of the magnetite are $Fe^{2+}$, $Fe^{3+}$ and $O^{2-}$.

Since these ions are all multiply charged ions, it is difficult for them to simultaneously satisfy a neutralization of electric charges and a suitable positioning of lattice structure during formation of the film. And the formed film has various defects in microscopic and macroscopic views.

In contrast thereto, the film produced onto the surface of a steel plate when using the salt bath of three component of $Li^+$, $Na^+$ and $K^+$ is the iron-lithium complex oxide. Since $Li^+$ ion has small ionic diameter, it can be incorporated into the iron oxide film as a constituent, thereby the iron-lithium complex oxide is produced.

Since $Li^+$ is a monovalent cation, it has an important function to simultaneously satisfy a neutralization of charges and a suitable positioning of lattice structure during formation of a film. By virtue of this function of $Li^+$, it is assumed that the film having less defects can be formed. Incidentally, it is known that $Li^+$ can move in the oxide even at a room temperature.

BEST MODE FOR CARRYING OUT THE INVENTION

EXAMPLE 1

Based on the general experience of the inventors that a film having adhesion property and corrosion resistance property can be formed only by applying nitriding salt bath where the content of the by-producted cyanide is low in the salt bath containing of anionic components of $CNO^-$ and $CO_3^{2-}$ and cationic components of $Li^+$, $Na^+$ and $K^+$, a test was carried out in order to find out preferable range of the film-forming process.

Since it was supposed that the aimed iron-lithium complex oxide film will be formed when the by-producted cyanide in the salt bath is at a low concentration, in this example 1, the content of $CNO^-$, which is a parent substance of producing the by-producted cyanide in the salt bath, was set at two concentration levels, that is 35 wt % as a standard concentration and 15 wt % as low concentration. The composition of the salt bath is shown in Table 1 below.

TABLE 1

| Component in Salt Bath | S2-1 | S2-2 |
|---|---|---|
| $Li^+$ (mol %) | 31 | 31 |
| $Na^+$ (mol %) | 26.5 | 26.5 |
| $K^+$ (mol %) | 42.5 | 42.5 |
| $CNO^-$ (wt %) | 35 | 15 |
| $CO_3^-$ | Balance | Balance |

60 Kg of salt mixture having composition of S2-1 in Table 1 was placed in a crucible made of titanium having a diameter of 350 mm and a depth of 500 mm to which a pipe for air bubbling was provided, and the mixture was then melted. 35wt % of $CNO^-$ was provided by coverting a carbonate according to a process shown in JP54-7502B.

The molten salt bath is maintained at 580° C. while air was blown from the bottom at a blowing rate of 150 L/Hr to ensure the homogeneity of the salt bath. The test was then carried out by using round bar of carbon steel S15C (20 mmϕ×8 mmt), cold rolled steel sheet SPCC (50 mm×100 mm×0.8 mmt) and iron powder (surface area: 8 $m^2$/120 g) of 60 mesh. Iron powder was used for increasing in experiment the processing area of iron materials. The carbon steel S15C and the cold rolled steel sheet SPCC were immersed in the salt bath for 90 min. at 580° C., water-cooled, washed with tap water and dried.

The iron powder in an amount of 120 g for each time was added into the molten salt bath 5 times a day at an interval of 90 min. At the time of the fifth addition of the iron powder, the carbon steel S15C and the cold rolled steel sheet SPCC were processed. At that time, sampling was made from the molten salt bath for the analysis.

At the end of the operation for one day, solid dregs in the molten salt bath were removed. The processing tests were continuously carried out for 8 days.

Figure 1:
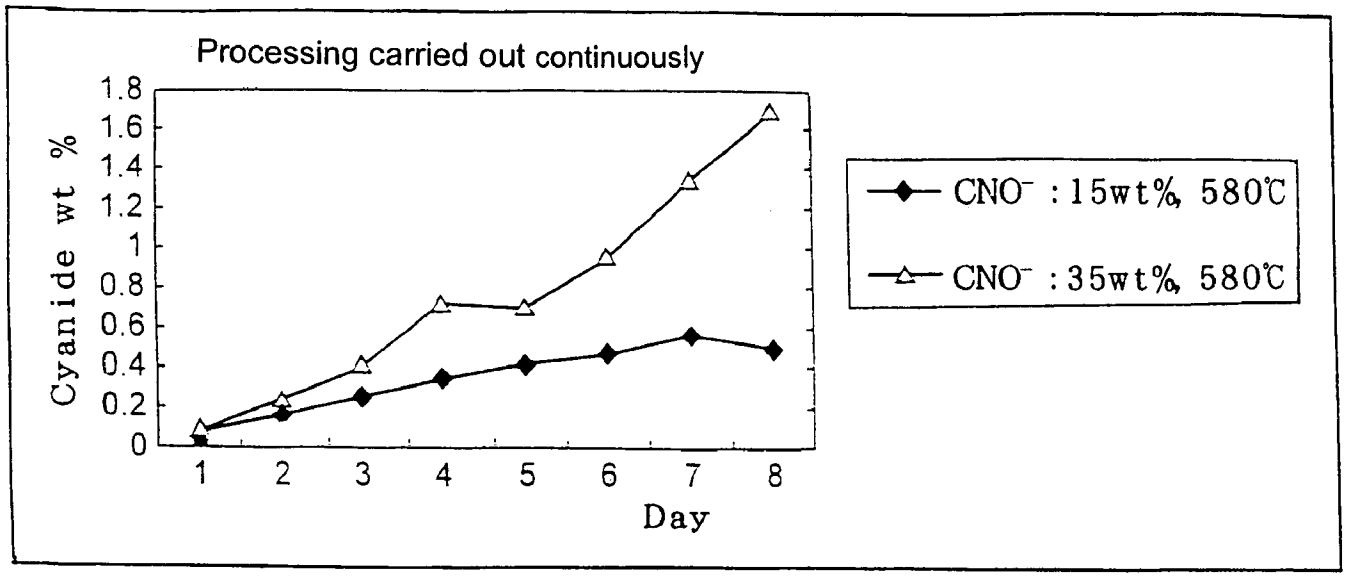
FIG. 1 is a graph showing a relation between cyanate concentration and by-producted cyanide concentration in the salt bath containing Li, Na and K.

The molten salt bath of a composition as shown in S2-2 in Table 1 was prepared in the same manner except the amount of $CNO^-$ is adjusted to 15 wt %. Then, the tests were carried out as same as in the case of the molten salt bath of S2-1. FIG. 1 shows the amount of the by-produced cyanide in the salt bath of S2-1 and S2-2 respectively.

It was determined that the content of the cyanide in both of the salt baths S2-1 and S2-2 at the starting time was zero respectively. In both salt baths of S2-1 and S2-2, it was recognized that the content of the cyanide gradually increased with the progress of the test.

In the salt bath of S2-1, the content of the cyanide was 0.4 wt % on the third day, and it reached to near 1.7 wt % on the eighth day and the content is still increasing.

On the other hand, in the salt bath of S2-2, the content of the cyanide was 0.26 wt % on the third day, it reached to the peak value of 0.54 wt % on the seventh day and then came to the equilibrium on the eighth day.

The external appearance of the carbon steel S15C and the cold rolled steel sheet SPCC after the test was checked. As a result, in case of salt bath of S2-1, a black-colored surface that seems to be containing iron-lithium complex oxide was recognized for both of S15C and SPCC until the third day. However, on the fourth day, it changed to a grayish color, which is considered to be a nitrided layer, and the grayish color in the appearance continued until the eighth day.

In contrast thereto, the test pieces of S15C and SPCC processed by the salt bath of S2-2 presented a black-colored appearance for all of the test specimen from the first day until the eighth day.

Table 2 shows the results of the salt water spray tests conducted for the test pieces processed by salt baths of S2-1 and S2-2 in accordance with JIS Z2371, respectively.

TABLE 2

Test Results Of Corrosion Resistance (Salt Water Spray Test in accordance with JIS Z2371: Hours until appearance of rust)

| Salt | | Day Of Salt Bath Treatment | | | | | | | |
|---|---|---|---|---|---|---|---|---|---|
| Bath | Material | 1st | 2nd | 3rd | 4th | 5th | 6th | 7th | 8th |
| S2-1 | S15C | >200 | >200 | >200 | 48 | 24 | 24 | 24 | 24 |
| | SPCC | >200 | >200 | >200 | 72 | 24 | 24 | 24 | 24 |
| S2-2 | S15C | >200 | >200 | >200 | >200 | >200 | >200 | >200 | >200 |
| | SPCC | >200 | >200 | >200 | >200 | >200 | >200 | >200 | >200 |

It was noted that there is a close relation between the corrosion resistance and the external appearance. All of the test pieces having black-colored appearance showed satisfactory corrosion resistance.

Figure 2:
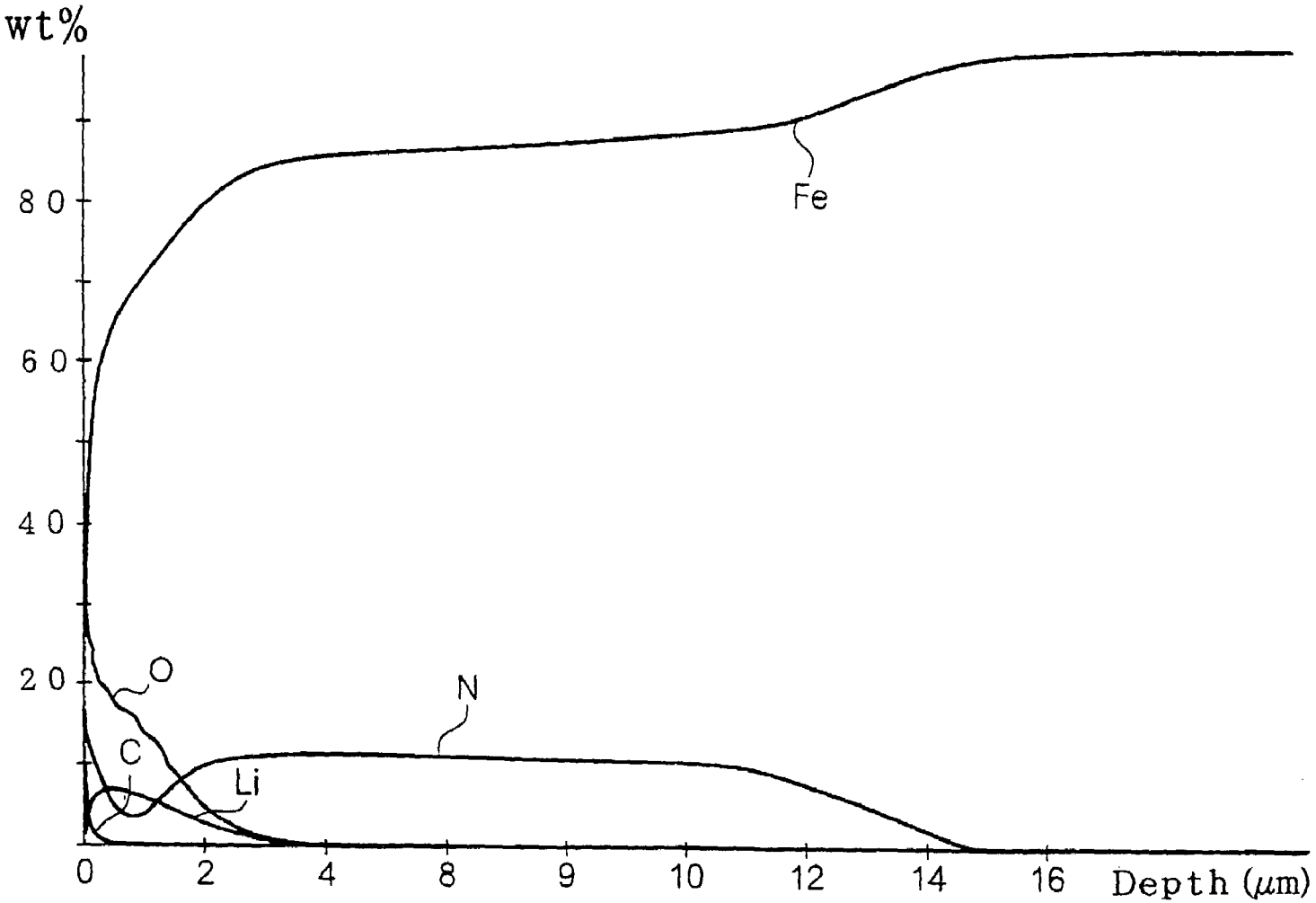
FIG. 2 is a graph showing an example of the composition of the film formed by the process according to the present invention.

FIG. 2 shows a result of analysis measured on the depth from the surface for the SPCC material treated in the salt bath of eighth day of S2-2 at 580° C. for 120 min. by means of glow discharge spectroscopy (GDS). As shown in FIG. 2, an iron-lithium complex oxide film of 2 to 3 μm thick exists on the outermost layer, and the nitrided layer of about 10 μm thick exists under that film.

In order to investigate an industrial life of the salt bath, the inventors of the present invention proceeded a long term running test where the salt bath of S2-2 is further continuously used for a long period of time. Like the tests described above, the long term running tests were carried out by using the same amount of iron powder and by applying the same test pieces of iron and steel parts, while the composition of the salt bath has been adjusted by supplementing the consumed component into the salt bath. The processing was conducted five days a week, and no processing was made on the weekend. During the weekend, temperature was kept and aeration was maintained.

In the long term running test of two months, the amount of the by produced cyanide in the salt bath was approximately at 0.5 wt %, and the external appearance of the treated metal pieces was black-colored. The results of the salt water spray tests indicated that the time until appearance of rust is more than 200 hours.

However, after three months from the start of the long term running test, the center and lower portions of the test pieces became grayish color, and the salt water spray tests indicated that the time until appearance of rust is shortened to 24 hours or less. The result of checking the content of the cyanide in the salt bath showed that the content is still maintained at around 5 wt %. However, analysis by X-ray diffraction showed that no iron-lithium complex oxide film was detected on the surface of the test pieces.

The inventors therefore started investigating why the iron-lithium complex oxide film that was formed in the early days did not appear after the long term running tests by using the salt bath of S2-2, in spite of being constantly maintained the contents of the components of the salt bath and the contents of by-produced cyanide. And a part of the molten salt used for the long term running tests was placed as samples into a crucible made of titanium having a diameter of 110 mm and a depth of 150 mm. And a method to recover the activity to form the iron-lithium complex oxide film was further investigated.

EXAMPLE 2

The inventors had considered the cause of no formation of the iron-lithium complex oxide film from various points view, whether it is because of accumulation of impurities in the salt bath, or whether it is because of other reason. As one of the trials, a part of the used molten salt was taken out and supplemented it with new salt. And an investigation was made to find out the suitable ratio to be substituted by the new salt in order to produce the iron-lithium complex oxide again.

As a result, it was found that, when only 15 wt % of the molten salt was substituted by new salt, then the ability to form the iron-lithium complex oxide revives again. Namely, 15 wt % of the molten salt used for the long term running tests was replaced with new salt. Then, the carbon steel of S15C and of the cold rolled steel sheet SPCC were immersed in the salt bath at 580° C. for 90 min. And it was found that the test pieces thus obtained showed a black-colored appearance and satisfactory adhesion, which are distinctive of iron-lithium complex oxide. From this result, it was considered that the ability to form the iron-lithium oxide film has been revived. In the salt water spray tests in accordance with JIS Z2371, it was found that the time until appearance of rust was longer than 200 hours for these test pieces.

It was supposed that, if the reason of no iron-lithium oxide comes from the accumulation of impurities in the salt bath, the amount of substitution of the salt must be at a greater ratio than 15 wt % in order to revive the ability to form the iron-lithium oxide film.

Then, the inventors speculated that the reason for the revival of the ability to form the iron-lithium complex oxide may be related with other properties of the newly added salt and not with the old used molten salt. Based on this speculation, they have expanded the investigation to know the real factor for the revival. The inventors have paid attention to the moisture contained in the salt for the supplement use.

Inventors provided a dried salt for the supplement use, which was provided by being placed the salt in a oven maintained at 300° C. for 5 hours (drying loss in this procedure was 3 wt %) in order to evaporate the free water in the salt. By using this dried salt, 15 wt % of the molten salt used for the long term running tests was substituted. The salt bath was kept at 580° C., and iron pieces of S15C and SPCC were immersed therein for 90 min. However, in this case, the iron-lithium oxide film was not formed, and the iron pieces showed grayish appearance that is considered to be the nitrided layer. Thus, in this case the ability to form the iron-lithium complex oxide was not recovered.

From this result, the inventors thought that the moisture in the salt bath acted to shift the basicity, namely $pO^{2-}$, of the salt bath to the basic side, thereby enhanced the oxidizing power of the salt bath, and the ability of the salt bath to form the iron-lithium complex oxide was revived.

Incidentally, hydroxide compound such as NaOH, KOH, and LiOH can be expressed by $Na_2O.H_2O$, $K_2O.H_2O$ and $Li_2O.H_2O$, respectively. In order to confirm the above, the NaOH was added at a rate of 0.3 wt % to the salt bath used for the long term running tests, then S15C and SPCC samples were immersed in the salt bath at 580° C. for 90 min. As a result, it was confirmed that the ability to form the black-colored iron-lithium oxide film was drastically improved.

Then, a mixture of NaOH, KOH and LiOH prepared by combining each of them at the mol % indicated in Table 1 was added at a rate of 0.3 wt % to the salt bath used for the long term running tests, and S15 and SPCC samples were immersed in the resultant salt bath at 580° C. for 90 min. As a result, the ability of forming the black-colored oxide film was also drastically revived as in the case where NaOH alone was added to the salt bath.

Test pieces to which the black-colored oxide film was formed were tested by the salt water spray test in accordance with JIS Z2371. As a result, time required until appearance of rust on the surface was found to be longer than 200 hours for all test pieces.

From these results of above, the inventors found out the second reason of not forming of iron-lithium complex oxide film. As explained before, after three months from the start of the long term running test, the center and lower portions of the test pieces became grayish color. However, it was a dry season when three months from the start of the long term running test in Kanto area where the inventor's laboratory resides. In the process, air bubbling has been applied to the salt bath. The air used for the air bubbling was natural air without applying humidity control thereto. It was understood that, because of low moisture content in the air used, the amount of moisture fed to the salt bath was low, which accordingly led to decrease the oxidizing ability of the salt bath, thereby causing no formation of the iron-lithium complex oxide film.

Based on this finding, examination was made in order to find out the absolute moisture content in the air to be preferably used for the bubbling of the salt bath. As a result, it was understood that the use of air with an absolute moisture content of more than $(1\times10^{-2}kg.H_2O)/(1$ kg dry air), and preferably more than $(2\times10^{-2}kg.H_2O)/(1$ kg dry air), is effective in order to proceed the nitriding and form the iron-lithium complex oxide film onto the surface of the iron parts.

The moisture supply to the salt bath is effective to enhance the oxidizing activity of the salt bath used in the present invention. Therefore, moisture supply by water and by steam may result in the good effect. However, it is not preferable because the supply of water or steam into the molten salts being at a high temperature is dangerous.

As described before, it is advantageous for the formation of the iron-lithium complex oxide film that the amount of the by-producted cyanide in the salt bath is as low as possible. In addition, for minimizing the unfavorable influence against the environment, the amount of the cyanide product in the salt bath should be kept as low as possible.

As mentioned in the foregoing, the addition of NaOH, KOH, and LiOH into the salt bath drastically enhances the oxidizing activity of the salt bath (it is presumed that the oxidizing activity of the cyanate in the salt bath is enhanced due to increase of the basicity in the salt bath). And even when the accumulated amount of the CW in the salt bath exceeded 2 wt % level, it is possible to simultaneously form the iron-lithium complex oxide film onto the surface of iron parts simultaneously with the nitriding.

However, the use of excess amount of alkali hydroxide should be limited to an appropriate extent since it may accelerate the decomposition of a cyanate, the main component for nitriding. (When basicity of the salt bath became high, the decomposition of the cyanate is accelerated.) The accumulated amount of $CN^-$ in the salt bath is preferably maintained in a range not more than 2 wt %, preferably not more than 1 wt %.

EXAMPLE 3

In the example 2, explanation was made on the cause of loss of the ability to form the iron-lithium complex oxide film in the salt bath being used for the long term and the means to recover the ability.

The salt bath of the invention is required to be stable for producing iron and steel parts of good and equal quality in order to make the invention as a commercial process.

In this respect, the inventors have investigated the suitable amount of supplemental alkali hydroxide that has a strong influence on the oxide film forming ability of the salt bath under the condition of using moistened air for the bubbling of the salt bath.

As described in example 2, the amount of the alkali hydroxide added to the salt bath for recovering the ability to form the iron-lithium oxide film was 0.3 wt % when the adding salt was NaOH alone or mixture of NaOH, KOH and LiOH at the mixing ratio indicated in Table 1.

However, further experiments were continued on the amount of alkali hydroxide to be added. And it was found that an addition of the alkali hydroxide in an amount of 0.005~0.05 wt % to a total weight of the salt bath for each treatment charge enables the salt bath to make the products of good and equal quality.

In order to form the iron-lithium complex oxide film simultaneously with the nitrided layer, it is required to maintain the content of $CN^-$ in the salt bath at not more than 2 wt %, preferably not more than 1 wt %. To comply with this requirement, it is effective to maintain the content of its parent component, namely $CNO^-$, at low.

Inventors have investigated the nitriding performance of the salt bath of the composition of S2-2 in Table 1 in relation with its content of $CNO^-$, and it was confirmed that the nitrided layer with a normal thickness can be obtained when the salt bath contains at least 5 wt % of $CNO^-$. However, when continuous processing are carried on, the content is preferably not less than 10 wt %.

In the conventional salt bath for nitriding process, the operations are carried out with the $CNO^-$ content at around 35 wt %. In that case, equilibrated $CN^-$ content is in a range of 1.about.2 wt % in many cases, though it cannot be fixed to that range since the loss of the salt may vary depending on the shape and size of the material to be processed. Based on the above, it is required to suppress the upper limit of $CNO^-$ content at not more than 35 wt %. And in order to maintain the $CN^-$ content at 1 wt % or less, it is preferable to keep the $CNO^-$ content to be not more than 25 wt % or less.

EXAMPLE 4

In the nitriding process, it is important that the salt bath has a composition to form more preferable nitrided layer.

In recent years, a nitriding process which arises less thermal stress in the treated metal is required. Therefore, the salt bath is preferably the one by which the processing at 450° C. can be realized. On the other hand, a cyanate has a melting point lower than that of its corresponding carbonate. And the inventors prepared a mixed salt for a salt bath for nitriding process containing lithium, sodium and potassium and having solidifying points of the mixed carbonate of Li, Na and K being to be lower than 500° C., and containing $CNO^-$ to be at 10 wt %, and the solidifying points of these samples were measured. The results are shown in Table 3.

TABLE 3

Solidifying temperature of salt containing 10% of cyanate

| | Salt Bath for Nitriding | | | | | | |
|---|---|---|---|---|---|---|---|
| Component | S1 | S2 | S3 | S4 | S5 | C1 | C2 |
| $Li^+$ mol % | 25.5 | 31.0 | 20.0 | 45.0 | 40.0 | 30.0 | 30.0 |
| $Na^+$ mol % | 45.0 | 26.5 | 20.0 | 25.0 | 45.0 | 10.0 | 55.0 |
| $K^+$ mol % | 30.0 | 42.5 | 60.0 | 30.0 | 15.0 | 60.0 | 5.0 |
| $CNO^-$ wt % | 10 | 10 | 10 | 10 | 10 | 10 | 10 |
| Solidifying point ° C. | 420 | 378 | 388 | 406 | 427 | 483 | 476 |

The carbon steel of S15C and the cold rolled steel sheet of SPCC were immersed in salt bath at 580° C. for 90 min. The compositions of salt bath are shown in Table 3, respectively. Cross sections of the obtained nitrided material were observed with an optical microscope to check the thickness of the compound layers and a thickness of the porous layers formed in the compound layer. The results are shown in Table 4.

TABLE 4

Salt Bath for Nitriding and Obtained Compound Layer

| | Salt Bath for Nitriding | | | | | | | | | | | | | |
|---|---|---|---|---|---|---|---|---|---|---|---|---|---|---|
| Material | S1 | | S2 | | S3 | | S4 | | S5 | | C1 | | C2 | |
| SPCC | CL | 10μ | CL | 11μ | CL | 8μ | CL | 10μ | CL | 11μ | CL | 4μ | CL | 15μ |
| | PZ | 0μ | PZ | 0μ | PZ | 0μ | PZ | 0μ | PZ | 1μ | PZ | 0μ | PZ | 8μ |
| S15C | CL | 12μ | CL | 12μ | CL | 10μ | CL | 13μ | CL | 12μ | CL | 6μ | CL | 19μ |
| | PZ | 0μ | PZ | 0μ | PZ | 0μ | PZ | 0μ | PZ | 1μ | PZ | 0μ | PZ | 8μ |

CL: Thickness of the compound layer
PZ: Thickness of the porous layer in the compound layer From the results shown in Tables 3 and 4, it was found out that the salt baths of S1, S2, S3, S4 and S5 are recommendable, because each of these salt baths has a solidifying point of lower than 450° C., and the nitriding performance, namely the thickness of the compound layer, is more than a normal level and having less porous layer. In contrast to S1 through S5, salt baths of C1 and C2 are not recommendable since solidifying points are higher than 450° C., and the salt bath of C1 is inferior in the thickness of the compound layer, and the property of the nitride layer formed in the salt bath of C2 was inferior since it contained a thick porous layer.

Figure 3:
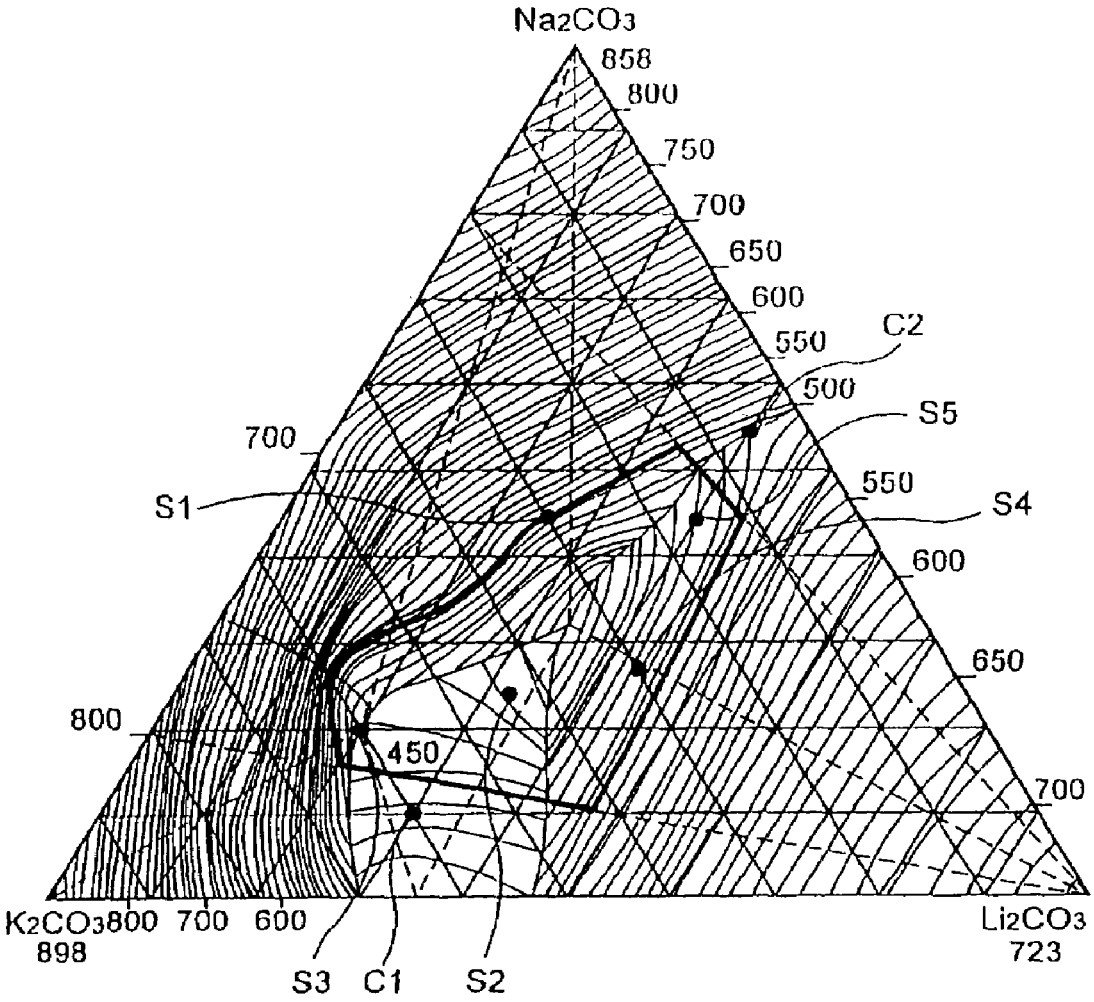
FIG. 3 is a diagram explaining a preferable range of composition of the salt bath.

From the results described above, it was found out preferable to use a salt bath containing alkali components at in a ratio where solidifying temperature of the mixed carbonate of $Li^+$, $Na^+$ and $K^+$ falls within a range surrounded by the solidifying temperature line of 500° C. in the phase diagram of carbonates of three elements of $Li^+$, $Na^+$ and $K^+$ as shown in FIG. 3, and wherein the mol ratio of $Na^+$ and $K^+$ falls within a range from 2:8 to 8:2.

EXAMPLE 5

<Test for Abrasion Resistance>

In the embodiment example, specimens of SPCC being treated in the salt bath of this invention on 8th day of its long term running test of example 1 were provided. And the treatment was processed with the salt bath at 580° C. for 90 min.

In the comparative example, specimens of SPCC material being treated by the conventional nitriding salt bath (TAFTRIDE TF1) were provided. And the treatment was processed with the salt bath at 580° C. for 90 min.

Abrasion resistance has been evaluated by measuring the maximum load with no scoring defects by using the SRV testing machine and in the condition as explained below.

Holding time: 60 sec

Step Load: 50N/50 sec

Slide distance: 2 mm

Slide frequency: 50 Hz

Lubricating oil: Base oil for engine oil

TABLE 5

| Treatment Process | Maximum Load with no Scoring Defects |
|---|---|
| Embodiment example | 1000, 950, 1000 |
| Comparative example | 750, 850, 900 |

From the results shown in Table 5, it is obvious that the materials processed by the salt bath according to the present invention are provided with abrasion resistance at least equal to or superior than that provided by the conventional nitriding process.

INDUSTRIAL APPLICABILITY

According to the process of the present invention, iron parts having excellent corrosion resistance and abrasion resistance can be obtained by carrying out the single nitriding process without requiring an additional electrolysis process.

The invention claimed is:

1. A nitriding process of iron and steel parts having an improved corrosion resistance, comprising:

immersing the iron and steel parts in a salt bath containing a cationic component of $Li^+$, $Na^+$, and $K^+$ and anionic components of $CNO^-$ and $CO_3^{2-}$, using a bubbling air having an absolute moisture content of more than ($1\times10^{-2}$ kg.$H_2O$)/(1 kg dry air) for mixing the salt bath in order to form an outermost film of iron-lithium complex on a nitrided layer.

2. A nitriding process of iron and steel parts according to claim 1, wherein the salt bath contains 3 cationic components of $Li^+$, $Na^+$ and $K^+$ in an containing ratio of being fall the solidifying temperature of the mixed carbonate of $Li^+$, $Na^+$ and $K^+$ within a range surrounded by solidifying temperature contour lines of 500° C. in the phase diagram of carbonates of these 3 components, and wherein the mol ratio of $Na^+$ and $K^+$ falls within a range from 2:8 to 8:2 and the content of anionic compounds $CNO^-$ is in a range of 5~35 wt %.

3. A nitriding process of iron and steel parts according to claim 1 wherein the accumulated content of the by-product cyanide in the salt bath is maintained at less than 2 wt % in $CN^-$.

4. The nitriding process of iron and steel parts according to claim 1, further comprising adding at least one hydroxide selected from the group consisting of lithium hydroxide, sodium hydroxide, and potassium hydroxide in an amount of 0.005–0.05 wt. % to a total weight of the salt bath for each treatment charge.

* * * * *